United States Patent [19]

Zipf, III et al.

[11] Patent Number: 4,909,053

[45] Date of Patent: Mar. 20, 1990

[54] HIGH SECURITY DOOR LOCKING DEVICE

[75] Inventors: Walter O. Zipf, III; Jack E. Zipf, both of Columbus; Kenneth W. Wheatley, Dublin; Dewayne H. Meyer, Westerville, all of Ohio

[73] Assignee: Liberty Telephone Communications, Inc., Westerville, Ohio

[21] Appl. No.: 195,554

[22] Filed: May 17, 1988

[51] Int. Cl.[4] ..... E05B 47/06

[52] U.S. Cl. ..... 70/283; 70/284; 70/380; 70/386; 292/144

[58] Field of Search ..... 70/284, 283, 277, 276, 70/386, 282, 380, 279; 292/252, 144

[56] References Cited

U.S. PATENT DOCUMENTS

| | | | |
|---|---|---|---|
| 1,695,518 | 12/1928 | Watson | 70/277 |
| 1,871,303 | 8/1932 | Chesick . | |
| 3,385,086 | 5/1968 | Patriquin | 70/460 |
| 3,599,454 | 8/1971 | Hill | 70/283 X |
| 3,600,915 | 8/1971 | Corboud | 70/380 X |
| 3,602,020 | 8/1971 | Kajita | 70/386 X |
| 3,889,501 | 6/1975 | Fort | 70/283 |
| 3,903,718 | 9/1975 | Fish | 70/156 |
| 4,062,056 | 12/1977 | Goodrich | 361/173 |
| 4,079,605 | 3/1978 | Bartels | 70/277 |
| 4,083,424 | 4/1978 | Von den Stemmen et al. | 180/114 |
| 4,148,092 | 4/1979 | Martin | 70/283 |
| 4,318,288 | 3/1982 | Rifat | 70/252 |
| 4,712,398 | 12/1987 | Clarkson et al. | 70/283 X |
| 4,761,976 | 8/1988 | Kleinhany | 70/277 |

FOREIGN PATENT DOCUMENTS

| | | | |
|---|---|---|---|
| 485725 | 5/1975 | Australia | 70/380 |

*Primary Examiner*—Lloyd A. Gall

[57] ABSTRACT

A High Security Door Locking Device comprises a locking cylinder including a latch control cam rotatably operable by a properly formed key received within the cylinder. An electrical solenoid is inserted into the rear of the cylinder with a retractable core which interferes with the operation of the latch control cam when the solenoid is unoperated. A solenoid controller is connected to operate the solenoid in response to entry of a defined code into the solenoid controller to thereby permit operation of the latch control cam. The solenoid controller operates the solenoid only for a selected period of time in response to the entry of a defined code such that a valid code must once again be entered into the controller if the cylinder is not operated during the enabled time period. The solenoid controller is programmable to permit a master user to disable codes to exclude the entry of previously authorized persons and to enable codes to permit the entry of newly authorized persons such that the cylinder does not have to be rekeyed to prevent entry of persons having a currently valid key but who are not authorized to enter the premises locked by the high security locking device.

15 Claims, 8 Drawing Sheets

HIGH SECURITY DOOR LOCKING DEVICE

BACKGROUND OF THE INVENTION

The present invention relates generally to high security door locks, and more particularly, to such a lock having a cylinder including a solenoid which must be operated to enable operation of the cylinder to unlock an associated door.

A deadlock wherein a bolt is moved only by turning a key or knob, commonly referred to as a deadbolt, is a very popular high security lock for both residential and business applications. In residential applications, the key which comes with or is originally fitted to the lock may be used over the entire life of the lock, or if the residence is sold or a key lost, the owners may choose to have the lock rekeyed. Thus, key changes in residential deadbolts are only infrequently made. In business applications, such is not the case.

Commonly, business deadbolts are rekeyed several times a year due to personnel changes, the loss of a key or simply as a periodic security practice to ensure that keys which may be available to unauthorized people will not operate the lock. Such rekeying operations require a locksmith to reconfigure or change the tumblers in the lock cylinder, and of course, cut new keys corresponding to the new tumbler configuration. While the charges for rekeying a lock may not be a major expense, oftentimes businesses have multiple locks and when one or more locks must be changed a number of times each year, the expenses can become substantial.

Another form of high security door locking device is disclosed in U.S. Pat. No. 3,903,718. The disclosed device comprises two independent lock mechanisms; one, a combination lock, is coupled to the second, a key lock, such that the device can be operated only if an appropriate code is entered into the combination lock and an appropriate key is inserted into the key lock. While this arrangement offers a potential solution to frequent rekeying operations by preventing a key from operating the locking device unless the combination code is also entered, once the code is known, it suffers from the same problems as the deadbolt lock in that the cylinder must be rekeyed and/or the code must be changed. In the disclosed locking device, possibly greater problems and expenses arise in the event of a code change since this requires either replacing the combination portion of the device or considerably more work than the rekeying operation.

Accordingly, a need exists for a high security door locking device which can be quickly changed to prevent entry into the area locked by the device by means of existing keys and/or codes without requiring cylinder rekeying operations or replacement or major changes to portions of the device. It would be further desirable if such a high security door locking device could be provided not only for new installations but also be readily retrofitted into existing locks at a cost which could be recovered within a relatively short period of time as compared to the alternative of having several lock cylinder rekeying operations performed over the same period of time.

SUMMARY OF THE INVENTION

The problems of the prior art high security door locking devices are overcome in accordance with the present invention by associating a solenoid with a locking cylinder which includes a latch control cam rotatably operable by a properly formed key received within the cylinder. The solenoid is associated with the cylinder such that a solenoid core either directly or indirectly interferes with the operation of the latch control cam unless the solenoid is operated to retract the core. A solenoid controller is associated with the solenoid and serves to operate the solenoid to permit operation of the cylinder, and hence, the latch control cam upon the entry of a defined code into the solenoid controller. By making the solenoid controller programmable such that a master user of the device can select a defined code or codes for operating the solenoid, the master user can directly prevent operation of the door locking device by means of lost or clandestinely obtained keys by changing the code which operates the solenoid without any physical changes to the cylinder, keys or other portion of the device.

In accordance with one aspect of the present invention, a high security door locking device comprises a locking cylinder including a latch control cam rotatably operable by a properly formed key received within the cylinder. Solenoid means are associated with the cylinder for interfering with the operation of the latch control cam. Solenoid control means connected to the solenoid means provide for operating the solenoid means to permit operation of the cylinder latch control cam in response to entry of a defined code. To reinstate the security of the locking device, the solenoid control means preferably operates the solenoid means only for a selected period of time in response to the entry of a defined code. If the locking cylinder is not operated to unlock the locking device during this period of time, the valid code must once again be entered into the solenoid control means to reenable operation of the cylinder latch control cam.

The solenoid control means is programmable to permit codes to be enabled and disabled by a master user of the device. This permits the master user to exclude the entry of a previously authorized person or a person in possession of a current, i.e., properly formed, key and a once valid code. The solenoid control means can be further programmable to enable use of one or more codes only during one or more defined time periods to selectively restrict the time of entry of persons having both a defined code and a current key.

In certain applications, it is desirable for the master user of the high security door locking device of the present invention to be able to unlock the door by entry of a code and use of a current key, with another person locking the door with only a key and without knowledge or entry of a defined code. Such applications may include convenience stores, fast-food restaurants, grocery stores and the like. For this mode of operation, the movable core is resiliently biased to extend from the solenoid means and the latch control cam is beveled on one side. The beveled side of the latch control cam permits rotational movement of the latch control cam in a direction to lock the door by engaging, riding up on and depressing the movable core with its beveled side. However, the side opposite the beveled side of the latch control cam engages the core which prevents rotational movement in a direction to unlock the door. Preferably, the side opposite the beveled side of the latch control cam and the core are ground such that engagement therebetween tends to extend the core from the solenoid to ensure that rotation of the latch control cam in the unlocked direction is precluded.

To discourage a person having a current key from trying a variety of codes in an attempt to discover an enabled code, it is preferred to have the solenoid control means refuse further entries for a defined lockout time period upon entry of a defined number of erroneous codes. For example, if three erroneous codes are entered one after the other, the solenoid control means will ignore all further entries for a period of five minutes. In addition, to draw attention to the fact that a number of erroneous codes have been entered, a visual and/or audible signal may be generated during the lockout period. For security analysis and to determine who may be attempting entry at unauthorized times or who may be divulging codes, the solenoid control means also preferably stores all codes entered and the times and dates of entry for later retrieval.

The locking cylinder may further comprise antimagnetic override means for preventing withdrawal of the core into the solenoid by means of a magnet applied to the outer face of the lock. When the solenoid is inserted into a corresponding horizontal cavity in the locking cylinder, the antimagnetic override means may comprise a cone-shaped chamber at the closed end of the cavity, with the core extending centrally into the chamber upon withdrawal into the solenoid. A ferrous ball bearing contained within the chamber will prevent withdrawal of the core into the solenoid since the ball bearing is initially drawn to the vertex of the cone-shaped chamber by the magnetic field applied to the locking cylinder and is sized to block full withdrawal of the core into the chamber. An additional locking safety measure is incorporated into the cylinder by grinding the core and latch control cam such that engagement of the cam with the core tends to extend the core out the solenoid as previously noted. By thus grinding the core and latch control cam, the possibility of depressing the core into an unoperated solenoid by "wiggling" a key received within the cylinder is precluded.

A novel locking cylinder structure in accordance with the present invention comprises a cylinder body including a latch control cam rotatably operable by a properly formed key received within the cylinder and an electrical solenoid embedded within the cylinder body. The solenoid includes a movable core which extends therefrom to interfere with the rotatable operation of the latch control cam unless the solenoid is activated to withdraw the core into the solenoid.

It is thus a primary object of the present invention to provide a high security door locking device wherein a solenoid is associated with a latch control cam of a locking cylinder to prevent operation of the locking cylinder with a properly formed key received within the cylinder unless a defined code is entered into a solenoid controller connected to the solenoid and responsive to entry of the code for operating the solenoid.

Another object of the present invention is to provide a locking cylinder for a high security door locking device which comprises a cylinder body including a latch control cam rotatably operable by a key received within the cylinder and an electrical solenoid embedded within the cylinder body and including a movable core which interferes with the rotatable operation of the latch control cam unless the solenoid is operated to withdraw the core into the solenoid.

It is yet another object of the present invention to provide an improved high security door locking device which requires a key and the entry of a defined code to open the device wherein the code may be readily selected and/or changed by a master user of the high security door locking device to thereby reduce the number of rekeying operations required.

Other objects and advantages of the invention will be apparent from the following description, the accompanying drawings and the appended claims.

DETAILED DESCRIPTION OF THE INVENTION

Figure 1:
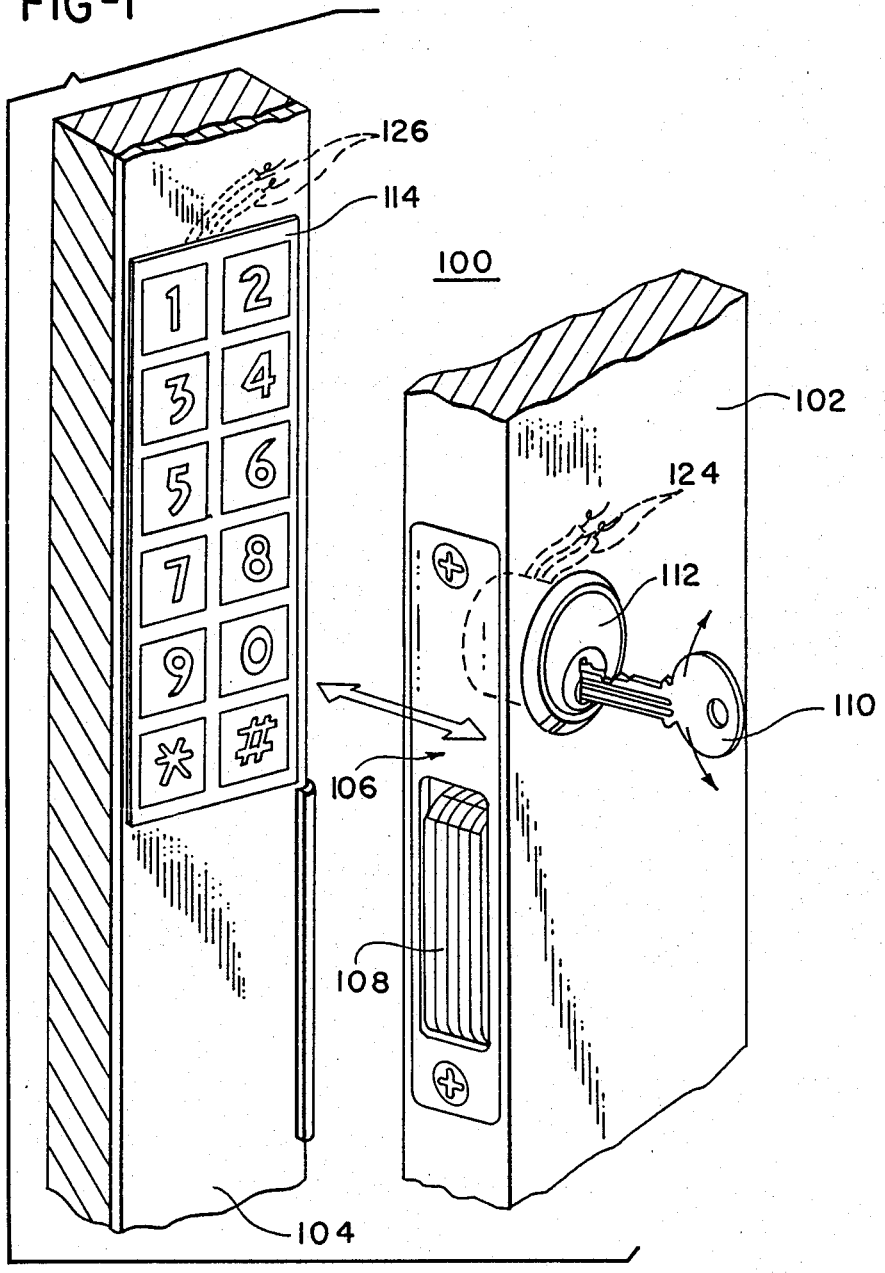
FIG. 1 is a broken portion of door and associated door jamb incorporating the high security door locking device including the locking cylinder of the present invention.
Figure 3:
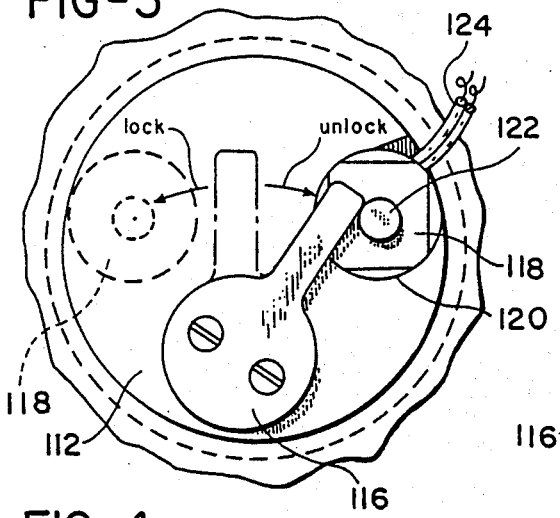
FIG. 3 is a rear view of the locking cylinder FIG. 2 shown on an enlarged scale.

A high security door locking device 100 in accordance with the present invention is shown in FIG. 1 in association with a section of a door 102 and a door jam 104. The device is applicable for a deadlock 106 wherein a bolt 108 is moved by turning a key 110 or a knob (not shown) which may be positioned on the inside of the door 102. Such a lock is commonly referred to as a "deadbolt" and provides a high level of security to both residential and business applications. In the past, where such deadbolt locks were used, if there is a breach of security due to a change of personnel, the loss of a key or the like, a cylinder 112 of the lock which receives the key 110 must be changed by reconfiguring or replacing tumblers within the cylinder 112 and then cutting key(s) which corresponds to the new tumbler configuration. The frequency of such changes is greatly reduced in accordance with the present invention which requires not only a properly formed key, but also the entry of an authorized code by means of a keyboard 114 or other data entry device which enables operation of the cylinder 112 by means of a properly formed key to unlock the door 102.

As shown in FIG. 1, the keyboard 114 is mounted on the door jam 104 associated with the door 102. While this is the preferred form of keyboard since the door jam is typically reinforced and will best support the keyboard 114, it should be apparent that the keyboard 114 can be mounted on the door 102, on the outer wall extending to the left of the door jam 104 in FIG. 1, or elsewhere as long as the keyboard 114 is convenient to the door 102, and in particular, the cylinder 112. It should also be apparent that alternate data input devices, such as infrared transmitter/scanner pairs, magnetic devices or the like could be used to enter data for operation of the high security door locking device 100 of the present invention.

Figure 2:
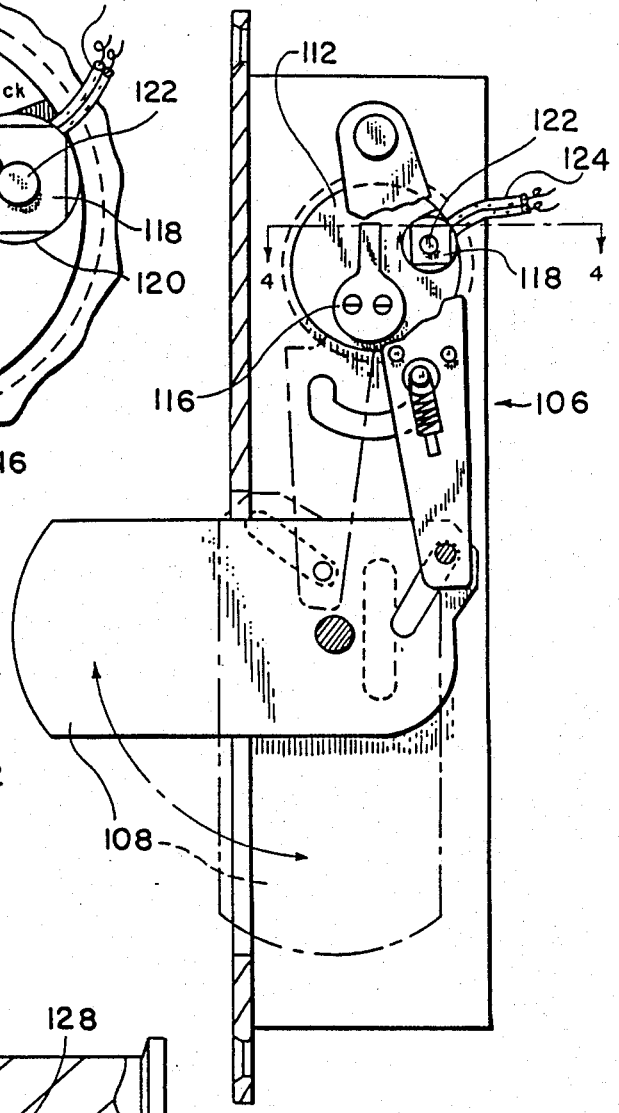
FIG. 2 is a side view of the deadbolt lock of FIG. 1 showing a rear view of the locking cylinder and a schematic view of the remainder of the deadbolt locking device.
Figure 4:
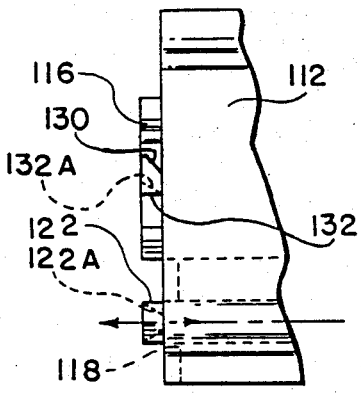
FIG. 4 is a side view of the back of the locking cylinder of FIG. 3 taken along the view line 4—4 of FIG. 2.
Figure 5:
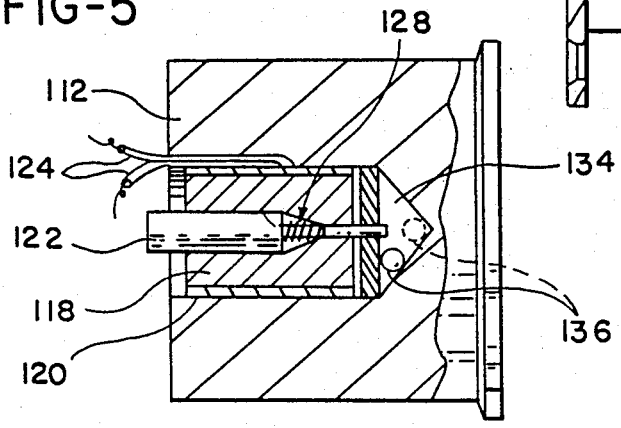
FIG. 5 shows a partially broken away side view of the cylinder of FIG. 3 including a partially sectioned solenoid.

The locking cylinder 112 is best illustrated in FIGS. 2–5, with operation of the cylinder 112 being shown in conjunction with the deadlock 106 which is shown in schematic form in FIG. 2. The deadlock 106 is a commonly used commercial lock whose operation is well known to those skilled in the art. Accordingly, operation of the deadlock 106 will be described only briefly herein in the interest of brevity and for ease of description. The locking cylinder 112 includes a latch control cam 116 which is rotatably operable by a properly formed key, such as the key 110, received within the cylinder 112.

In accordance with the present invention, solenoid means comprising a solenoid 118 in the illustrative embodiment, is inserted into a cavity 120 formed into the back of the cylinder 112 for interfering with the operation of the latch control cam 116. The solenoid 118 is mounted such that its face is flush with or below the back face of the cylinder 112 and a core 122 of the solenoid 118 is sized and resiliently biased to extend beyond the solenoid 118, and more importantly, beyond the back face of the cylinder 112 when the solenoid 118 is unactivated.

In the illustrative embodiment wherein the solenoid 118 is inserted into the back of the cylinder 112, the core 122 of the solenoid 118 directly interferes with the operation of the latch control cam 116. Of course, alternate embodiments of the present invention will be apparent in view of this description wherein an externally mounted solenoid either directly or indirectly interferes with the operation of the latch control cam 116. Solenoid control means, shown in FIG. 6 and further described with reference to FIGS. 6–20, is connected to the solenoid 118 via wires 124 such that it can operate the solenoid 118 in response to the entry of a defined code, for example, by means of the keyboard 114 which is connected to the solenoid control means via the wires 124.

While the solenoid 118 is operated, the latch control cam 116 of the cylinder 112 is freely rotatable due to the withdrawal of the core 122 into the solenoid 118. Accordingly, the latch control cam 116 can be operated by means of a current, properly formed key to lock or unlock the door 102. To reinstate the security of the locking device 100, the solenoid control means preferably operates the solenoid 118 only for a selected period of time in response to the entry of a defined code. If the person who enters the code does not operate the lock during this period of time, a valid code must be reentered into the solenoid control means to once again operate the solenoid 118 and thereby reenable operation of the latch control cam 116 of the cylinder 112.

The solenoid control means is programmable to permit codes to be enabled and disabled by the master user of the device. Programmability permits the master user to exclude the entry of a previously authorized person, or a person in possession of a current key and a once valid code. The solenoid control means can be further programmable to enable use of one or more codes only during one or more defined time periods to selectively restrict the time of entry of persons having both a defined code and a current key.

It may be desirable for one person to be able to unlock the door by entry of a code via the keyboard 114, or otherwise, in conjunction with the use of a current key, with another person locking the door with only a key and without knowledge or entry of a defined code. Many such applications will come to mind, for example, the manager of a grocery store, fast-food restaurant, convenient store or the like who would be required to initially enter the facility, but who would then authorize an employee to close up and lock the facility.

The present high security locking device provides for this mode of operation, with the illustrative embodiment being particularly easily adapted to function in that manner. Since the core 122 is resiliently biased by means of a spring 128 which forms part of the solenoid 118, see FIG. 5, it is possible to provide a latch control cam 116 which is beveled on one side as shown at 130 in FIG. 4. The beveled side 130 of the latch control cam 116 permits rotational movement of the latch control cam 116 in a direction to lock the deadlock 106, and hence, the door 102 by engaging, riding up on and depressing the movable core 122 with the beveled side 130 such that the latch control cam 116 can pass over the core 122 of the solenoid 118 in the direction to lock the deadlock 106 even when the solenoid 118 is unoperated. On the other hand, the side 132 opposite to the beveled side 130 of the latch control cam 116 engages and abuts the core 122 and cannot depress and therefore pass over the movable core 122 when the lock control cam 116 is turned in the direction to unlock the deadlock 106, and hence, the door 102.

The core 122 may be cylindrical, as shown, and the side 132 of the latch control cam 116 substantially flat to effect a positive abutment or engagement between the two. However, as a safety measure and to ensure that the core 122 does not tend to be depressed by the side 132 of the cam 116 by "wiggling" a key in the cylinder 112, it is preferred that the core 122 be slightly ground as shown by the dotted-lines 122A in FIG. 4 such that it's tip takes the appearance of an inverted frustum. To match the grind on the core 122, the side 132 of the latch control cam 116 is slightly ground as shown by the dotted line 132A in FIG. 4. In this way, the cam 116 tends to withdraw the core 122 from the solenoid 118 when the cam 116 is moved to unlock the lock with the solenoid 118 unactivated. It is noted that the grind angles indicated by dotted lines 122A and 132A are greatly exaggerated and that grind angles of a few degrees are sufficient to accomplish this safety measure.

To prevent withdrawal of the core 122 into the solenoid 118 by means of a magnet applied to the outer face of the cylinder 112, the locking cylinder 112 may further comprise antimagnetic override means. When the solenoid 118 is inserted into a corresponding horizontal cavity 120 in the back of the locking cylinder 112, as in the illustrative embodiment, the antimagnetic override means may comprise a cone-shaped chamber 134 formed at the closed end of the cavity 120 and a ferrous ball bearing 136 contained within the chamber 134.

The inner end of the core 122 extends centrally into the chamber 134 upon withdrawal into the solenoid 118. The ferrous ball bearing 136 is contained within the chamber 134 and sized relative to the resiliency of the spring 128 such that the ball bearing 136 is initially drawn to the vertex of the cone-shaped chamber 134 by a magnetic field which is sufficiently strong to retract the core 122 into the solenoid 118. Accordingly, the magnetic field positions the ball bearing 136 such that it blocks withdrawal of the core 122 into the chamber 134 and the latch control cam 116 will not be enabled to rotate in the unlock direction. Alternately, the antimagnetic override means can comprise orienting the solenoid 118 at an angle relative to the axis of the cylinder 112 such that a direct magnetic field would cause the core 122 to bind or provide insufficient force along the axis of the core 122 to retract it.

Figure 6:
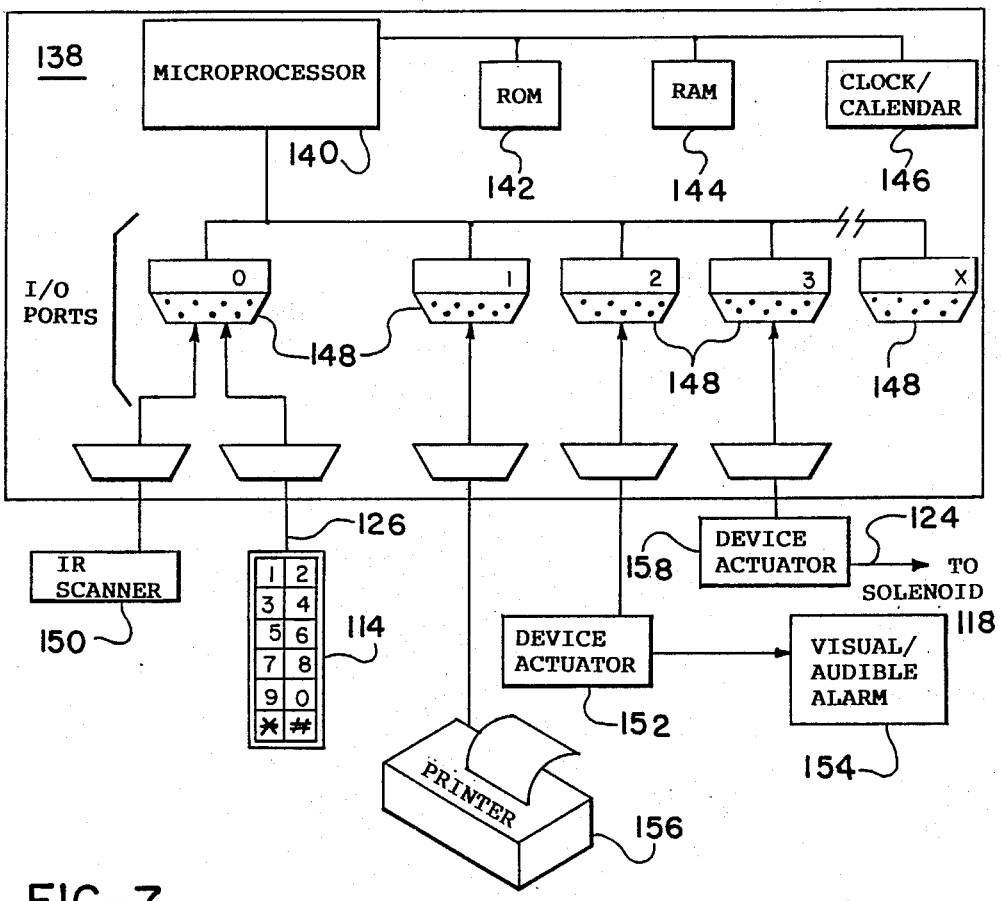
FIG. 6 is a block diagram of a solenoid controller for use in the present invention.

FIG. 6 is a block diagram of solenoid control means for operating the solenoid 118 to permit operation of the latch control cam 116 in response to entry of a defined code. In the illustrative embodiment, the solenoid control means comprises a controller 138 including a microprocessor 140. A read-only memory (ROM) 142, random access memory (RAM) 144 and clock/calendar 146 are associated with and provide information and data storage for the microprocessor 140. A number of input/output (I/O) ports 148 are associated with the microprocessor 140 to provide input and output communications with the microprocessor 140 in accordance with well known microprocessor technology.

One of the I/O ports 148, identified as I/O port 0 in FIG. 6, receives the signals from the keyboard 114 via the wires 124, or alternately receives input signals from an infrared scanner 150 or other input device, with the input signals serving to control and/or program the microprocessor 140. A single controller 138 can be accessed from a number of different doors in the same building. For each additional door, two I/O ports are utilized, one to receive input signals and a second to control the associated solenoid for the additional door.

In accordance with the present invention, the controller 138 is programmable to permit codes to be enabled and disabled by a master user of the high security locking device 100. This permits the master user to exclude the entry of a previously authorized person simply by deleting that person's previously valid code even though the person continues to retain a properly formed key or has clandestinely duplicated a key. The master user can, of course, enable new codes as employees are added or as the need arises.

The controller 138 can also be programmable to enable use of one or more valid codes only during one or more defined time periods to selectively restrict the time of entry of persons having both a defined or authorized code and a current key. For example, a cleaning crew may be authorized to enter premises during selected night hours, but would not be authorized to enter the same premises during weekends or holidays.

To discourage a person having a current key from trying random codes in an attempt to discover an enabled code, the controller 138 preferably refuses further code entries for a defined lockout time period upon consecutive entry of a defined number of erroneous codes. For example, if three erroneous codes are entered, one after the other, the controller 138 will ignore all further code entries for a period of five minutes. In addition, to draw attention to the fact that a number of erroneous codes have been entered, a device actuator 152 may be controlled by the microprocessor 140 to activate a visual and/or audible alarm 154. Such an alarm preferably would be placed over the associated door 102 to provide some degree of security for the alarm. The visual and/or audible alarm 154 can be activated during the entire lockout time period, during some preliminary portion thereof, or intermittently.

For security analysis and to determine who may be attempting entry at unauthorized times or who may be divulging authorized codes, the controller 138 preferably stores all codes entered and the times and dates of entry for later retrieval. Such retrieval may be requested via the input device, for example, the keyboard 114, and the requested information can be printed out, for example, by means of a printer 156 connected to an I/O port of the microprocessor 140. Another device actuator 158 is connected to the solenoid 118 and controlled by the microprocessor 140 to activate the solenoid 118 upon entry of a valid or authorized code as previously described.

The operation and programming of an illustrative embodiment of the controller 138 shown in FIG. 6 will now be described with reference to the flow charts shown in FIGS. 7–20. For purposes of illustration, the codes comprise five digit numbers, with the first digit, the "user digit", identifying the user of the high security locking device 100 such that up to 10 users can be accommodated. Of course, the codes can be expanded such that there can be 100, 1000, or any reasonable number of users. The remaining four digits comprise the "entry code". In the illustrative embodiment, the ultimate controlling user is identified as the "grand master" and is assigned the user digit of 0. The second-in-command, if any, is referred to as the "master" and is assigned the user digit 1. For this grand master/master embodiment the grand master is able to change any code including his own and the master's code while the master can change any code except his own or the grand master's.

Figure 7:
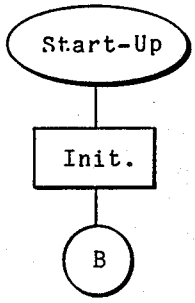
FIGS. 7–20 flow charts showing the programming and operation of the solenoid controller of FIG. 6.
Figure 11:
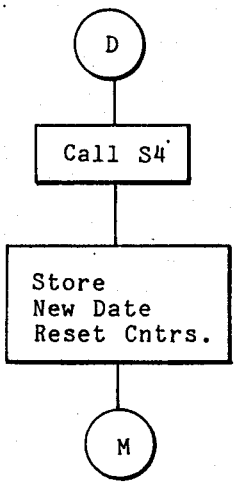
Figure 12:
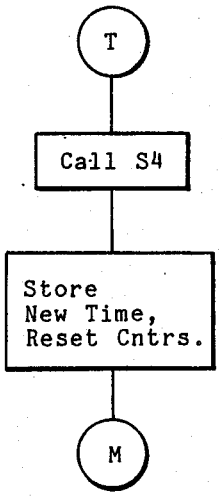
Figure 8:
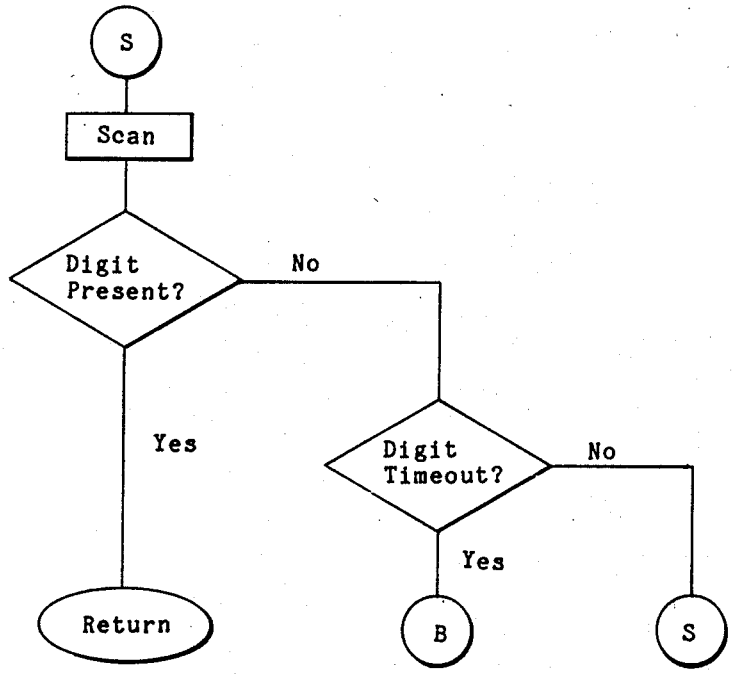
Figure 13:
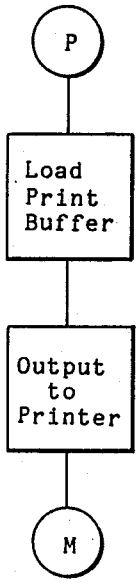
Figure 14:
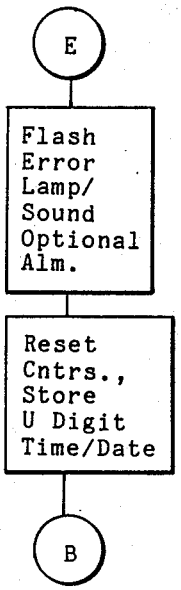

Upon initially powering up the high security door locking device 100, which preferably should have battery backup to ensure that the clock/calendar 146 and the RAM 144 retain accurate information, the microprocessor 140 is initialized, see FIG. 7. After initialization, a digit scan routine shown in FIG. 8 is called from the program sequence shown in FIG. 9 and I/O port 0 is scanned by the microprocessor 140 until a time out period elapses or an input digit is received, for example from the keyboard 114, at which time program control returns to the point from which the scan routine was called. If additional doors are controlled, additional I/O ports corresponding to those doors would also be scanned to receive input digits originating at the doors. The initial digit of the code inputed to the microprocessor 140 comprises a user digit and, as previously noted, identifies up to 10 different users of the device. The microprocessor 140 stores the user digit, time and date of entry, and input port (if more than one door is controlled).

The microprocessor 140 once again scans I/O port 0 in anticipation of the input of either a maintenance digit such that the microprocessor 140 can be programmed, or an entry code to enable operation of the device by means of a current key. If a maintenance digit, for example a * or #, is initially received, this tells the microprocessor 140 that it is to be programmed by the grand master or master and it progresses to program sequence M shown in FIG. 10. If no maintenance digit is received, the microprocessor 140 progresses to program sequence N shown in FIG. 15. The microprocessor 140 can be programmed to change the authorized codes (delete or add one or more codes), change the date, change the time, printout collected data, set time/date restrictions on authorized codes, or other alternate functions. Each of these operations is identified by a code comprising a number of digits which identify the task to be accomplished.

Figure 16:
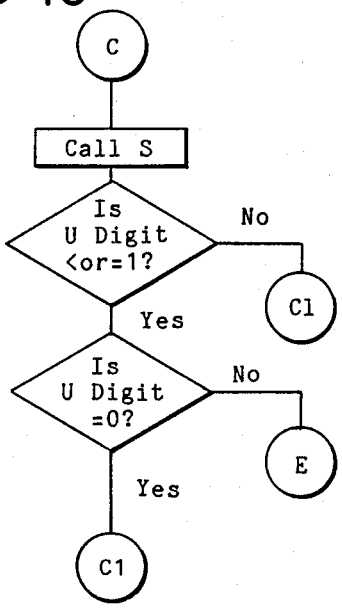
Figure 17:
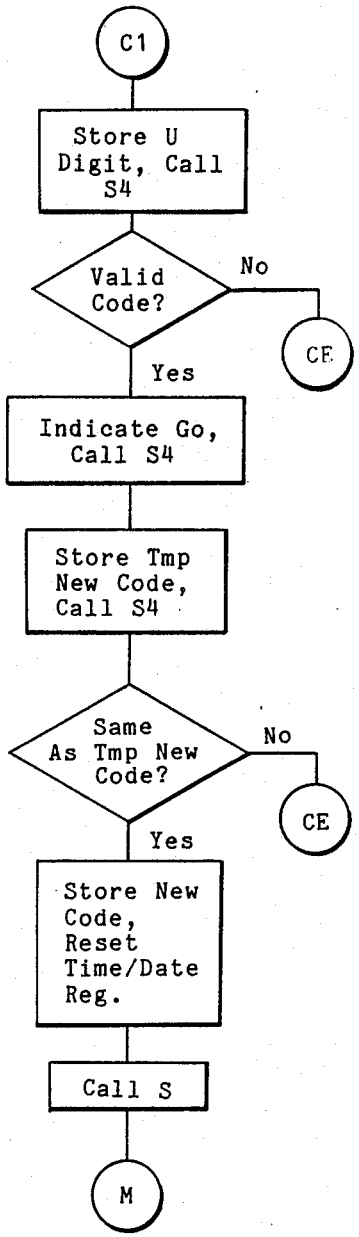
Figure 10:
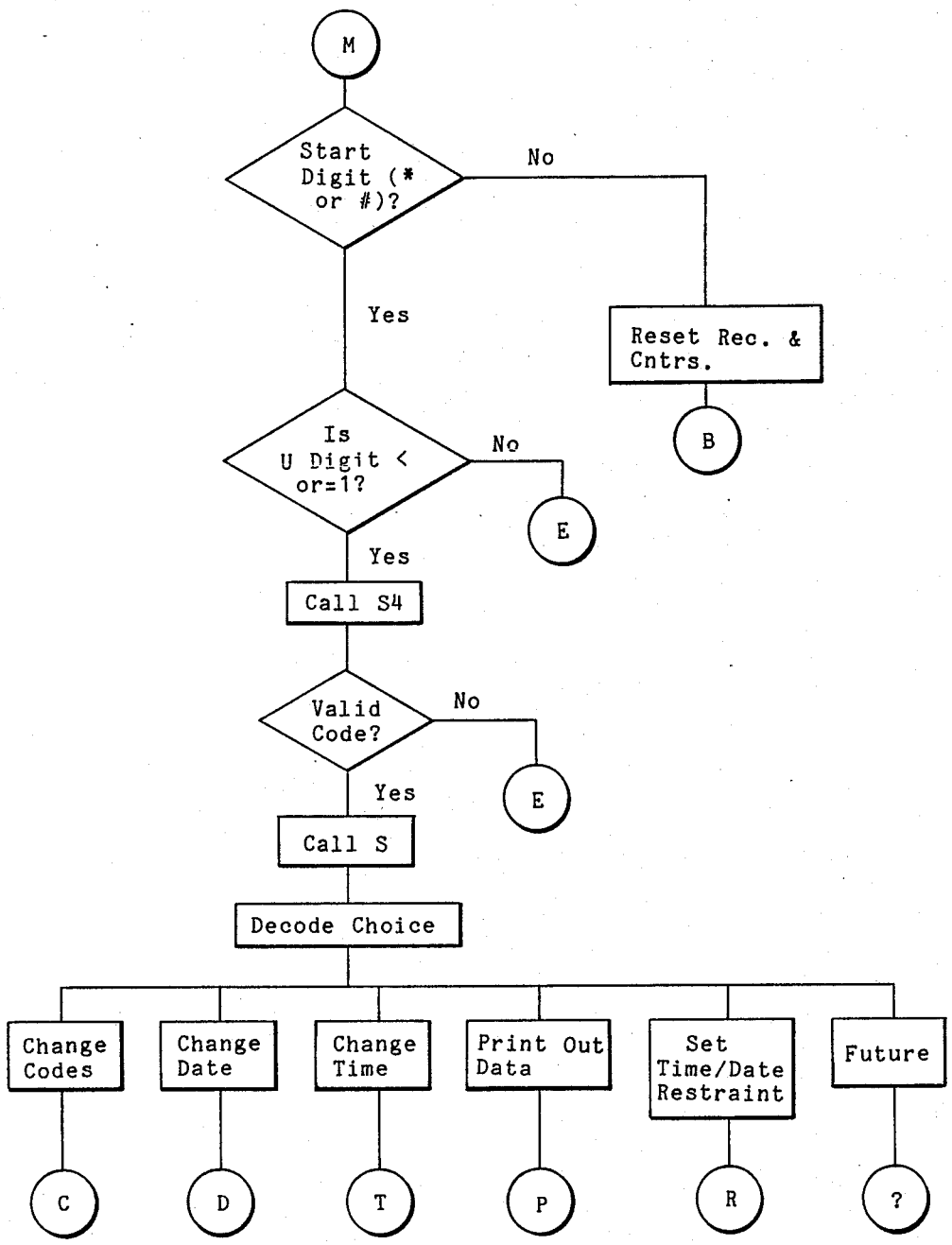
Figure 20:
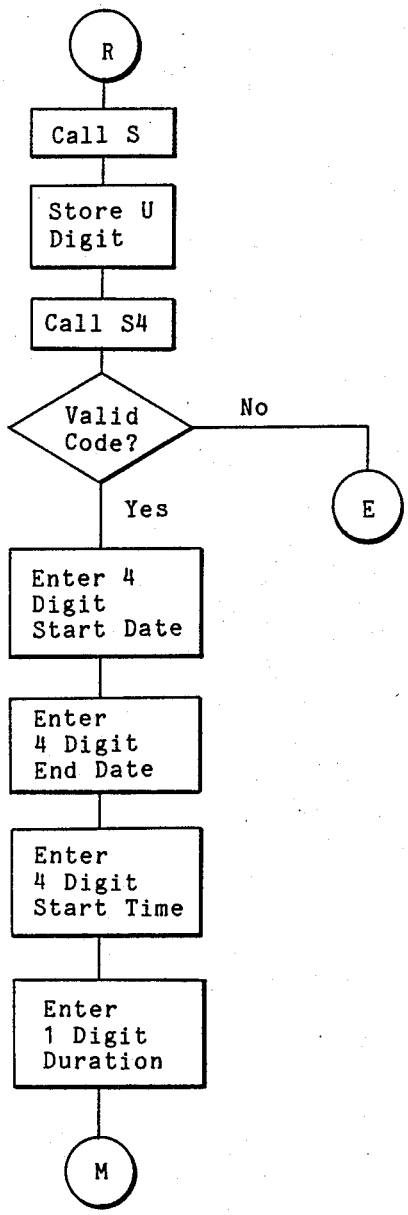

Flow charts are shown for: changing codes (FIGS. 16 and 17); changing dates (FIG. 11); changing times (FIG. 12); printing out data (FIG. 13); and, setting time/date restrictions on authorized codes (FIG. 20). In FIGS. 16 and 17, the input digits of the code to be changed are scanned, with the first digit being examined to determine whether it is less than or equal than 1, i.e., 0 (grand master) or 1 (master). If it is, the user digit of the initially entered code is examined to determine whether the user is the grand master. If the user is the grand master, then the code change can be made. If it is only the master, an error is indicated since the master cannot change any grand master or master codes, i.e., codes beginning with 0 or 1, but can only change codes below the master level. If the user digit of the code to be changed is not 0 or 1, the entered user digit is stored.

Figure 19:
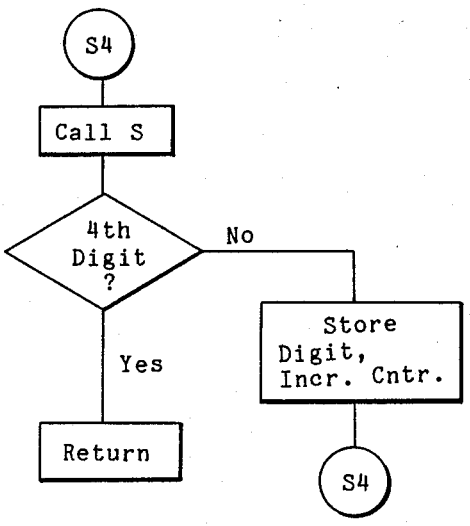

Digits subsequent to the first or user digit are received by a digit accumulation routine shown in FIG. 19, stored and the digit counters incremented until the entire entry code has been received. It may be desirable to include a display such that the microprocessor 140 can display the entered code; however, this is not necessary in accordance with the present invention. The entered digits are verified to determine that the code entered is the code for the selected user and the system is then ready to receive the new code. Again the digit accumulation routine of FIG. 19 is called to accumulate the new four digit entry code. To ensure that the four digit code has been entered correctly, the same four digits must be entered twice in succession in order to be accepted by the microprocessor 140. If the two four digit codes which are entered differ from one another, a user error indication is generated, see FIG. 18, and the user can try again.

Figure 9:
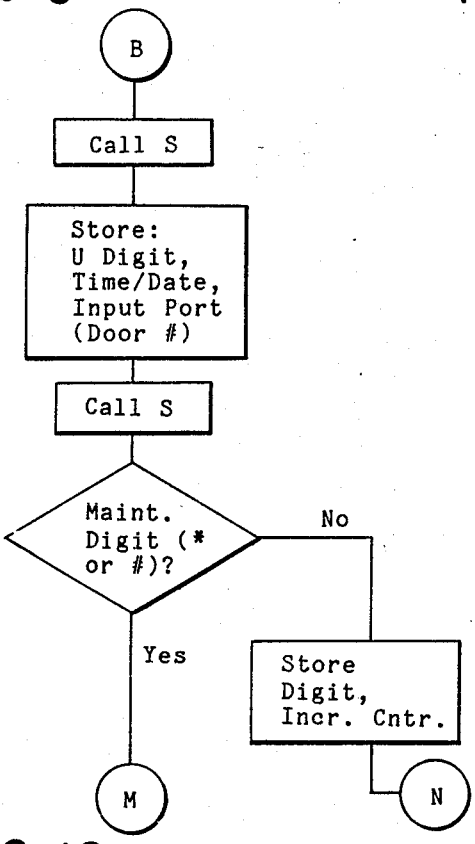
Figure 15:
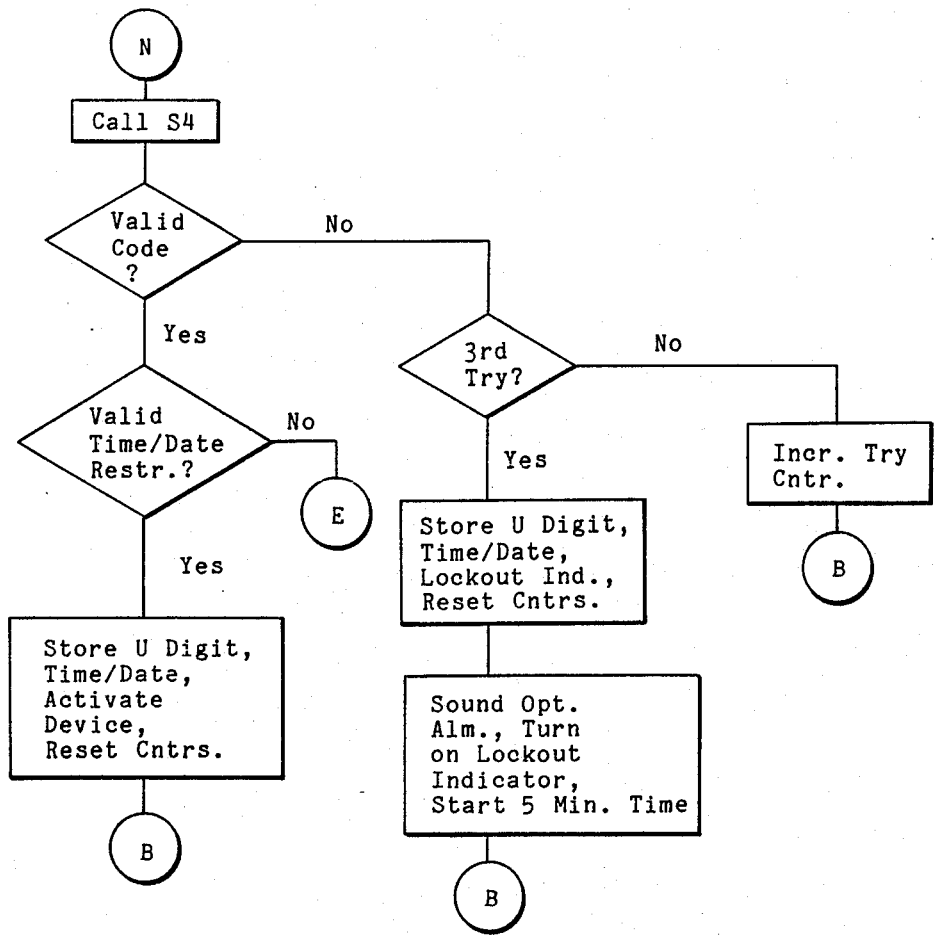
Figure 18:
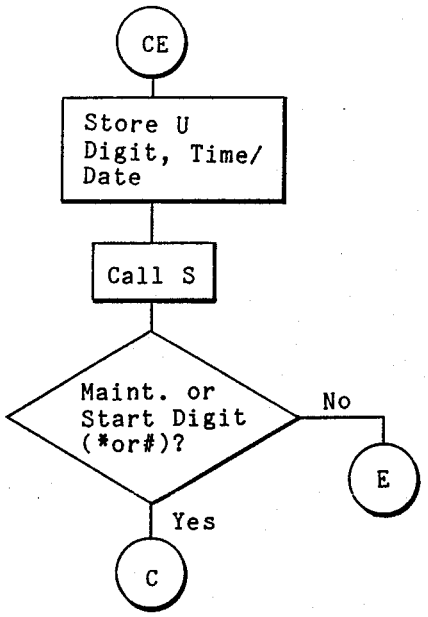

With reference once again to FIG. 9, if a maintenance digit is not entered, the system continues to scan for an entry code and then the digits are stored in incoming digit registers. The digits are scanned, as shown in FIGS. 15 and 19, and compared by the microprocessor 140 to valid or currently authorized codes. If a valid code has been entered, the device actuator 158 for the corresponding door (if more than one door is controlled) is activated for a selected period of time to activate the corresponding solenoid 118 which enables operation of the cylinder 112 by means of a current key. The system then returns to its standard scanning configuration as shown in FIG. 9. FIG. 15 also shows the generation of a timed lockout period in the event that three invalid codes have been entered in seriatim. The lockout time period, in addition to rejecting any further entry of codes for the period of time (five minutes as indicated in FIG. 15), may also activate the device actuator 152 which, in turn, activates the visual/audible alarm 154, as previously described, see FIG. 14.

FIG. 20 shows the program sequence for setting time and/or date restraints on authorized codes. As previously noted, this allows codes to be authorized or enabled only during programmed times and/or dates. If a code is to be restricted, the grand master or master can select a start date (month and day), an end date (month and day), a start time and a time period or duration of the authorized entry period. The restricted codes can then be used to operate the device only during the programmed time period on the dates selected.

In view of the above description, it is apparent that a high security door locking device 100 has been described which the user can control to prevent entry into an area locked by the device merely by programming the microprocessor 140 to eliminate a previously activated code and without requiring cylinder rekeying operations or replacement or major changes to portions of the device. It is noted that the high security door locking device 100, in accordance with the present invention, can be conveniently retrofitted into existing locks such as the basic deadlock 106 simply by replacing the existing cylinder with a cylinder 112 including a solenoid 118 as disclosed herein together with the associated data entry device, such as the keyboard 114, and the solenoid controller 138. Hence, the high security door locking device of the present application can be readily retrofitted into existing locks to reduce the number of rekeying operations required on an annual basis such that the cost of retrofit can be quickly recovered.

While the forms of apparatus herein described constitute preferred embodiments of this invention, it is to be understood that the invention is not limited to these precise forms of apparatus and that changes may be made therein without departing from the scope of the invention which is defined in the appended claims.

What is claimed is:

1. A high security door locking device comprising:

a locking cylinder including a latch control cam rotatably operable by a properly formed key received within said cylinder;

solenoid means associated with said cylinder including a movable core and means for resiliently biasing said movable core to extend therefrom when said solenoid means is in an unenergized state thereby to interfere with the rotatable operation of said latch control cam, said movable core being withdrawn from the interfering position upon energization of said solenoid means;

means for preventing the withdrawal of said movable core from the interfering position in the presence of an external magnetic field; and solenoid control means connected to said solenoid means and responsive to entry of a defined code for energizing said solenoid means to permit rotation of said latch control cam.

2. The device of claim 1 further including an opening in said cylinder into which said solenoid means is placed, said opening have an open end through which said movable core extends for operation with said latch control cam, a closed end, and a chamber at said closed end into which said movable core extends upon energization of said solenoid, wherein said means for preventing the withdrawal of the movable core from the interfering position includes a member of magnetic material positioned in said chamber which will have into position between the closed end of the opening and the movable core in the presence of an external magnetic field.

3. The device of claim 2 wherein said chamber at the closed end of said opening is conical and wherein said member of magnetic material is a ferrous ball member which will be drawn toward the vertex of the chamber by an external magnetic field.

4. A high security door locking device comprising:

a locking cylinder including a latch control cam rotatably operable by a properly formed key received within said cylinder;

solenoid means associated with said cylinder including a movable core and means for resiliently biasing said movable core to extend therefrom when said solenoid means is in an unenergized state thereby to interfere with the rotatable operation of said latch control cam, said movable core being withdrawn from the interfering position upon energization of said solenoid means, said latch control cam being beveled on one side to permit rotational movement of said latch control cam in a direction to lock said door locking device by engaging and depressing said movable core with the beveled side of said latch control cam for movement of said latch control cam beyond said movable core in the lock direction but to prevent rotational movement of said latch control cam in a direction to permit said door locking device to be unlocked whereby said high security door locking device can be unlocked only when said solenoid means is energized, and locked whether or not said solenoid means is energized; and solenoid control means connected to said solenoid means and responsive to entry of a defined code for energizing said solenoid means to permit rotation of said latch control cam in the unlocked direction.

5. In a high security door locking device, a locking cylinder comprising:

a cylinder body including a latch control cam rotatably operable by a properly formed key received within said cylinder body; and an electrical solenoid embedded within said cylinder body, said solenoid including a movable core extending therefrom to interfere with the rotatable operation of said latch control cam unless said solenoid is activated to withdraw said core into said solenoid;

wherein said movable core is resiliently biased to extend from said solenoid and said latch control cam is beveled on one side to permit rotational movement of said latch control cam in a locking direction by engaging and depressing said core with said beveled side of said latch control cam for movement of said latch control cam beyond said core in a locking direction, said latch control cam being blocked from rotational movement in an unlocking direction by the side opposite to said beveled side engaging said extended core whereby said high security door locking device can be unlocked by operation of said solenoid and locked without operation of said solenoid; and wherein said movable core and the side of said latch control cam opposite to said one side are ground such that engagement therebetween tends to extend said movable core from said solenoid.

6. In a high security door locking device, a locking cylinder as claimed in claim 5 further comprising antimagnetic override means for preventing withdrawal of said core into said solenoid by means of a magnetic field.

7. In a high security door locking device, a locking cylinder as claimed in claim 6 wherein said solenoid is inserted into a corresponding horizontal opening in said locking cylinder and said antimagnetic override means comprises a cone-shaped chamber at a closed end of said opening, said core extending centrally into said chamber upon withdrawal into said solenoid, and a ferrous ball bearing contained within said chamber whereby said solenoid can be operated to withdraw said core unless said ball bearing is initially drawn to the vertex of said cone-shaped chamber by a magnetic field applied to said locking cylinder.

8. A high security door locking device comprising:

a locking cylinder including a latch control cam rotatably operable by a properly formed key received within said cylinder;

solenoid means associated with said cylinder for interfering with the operation of said latch control cam; and solenoid control means connected to said solenoid means and responsive to entry of a defined code for operating said solenoid means to permit operation of said latch control cam, wherein said solenoid control means operates said solenoid means for a selected period of time in response to the entry of a defined code, wherein said solenoid means is incorporated into said locking cylinder and includes a movable core extending therefrom to interfere with the rotatable operation of said latch control cam, said movable core being withdrawn by said solenoid means in response to entry of a defined code in said solenoid control means, wherein said solenoid control means is programmable to permit said defined code to be selected, wherein said movable core is resiliently biased to extend from said solenoid means and said latch control cam is beveled on one side to permit rotational movement of said latch control cam in a direction to lock said door locking device by engaging and depressing said movable core with the beveled side of said latch control cam for movement of said latch control cam beyond said movable core in the lock direction but to prevent rotational movement of said latch control cam in direction to permit said door locking device to be unlocked whereby said high security door locking device can be unlocked by entry of a defined code in said solenoid control means and locked without knowledge of entry of a defined code, and wherein said movable core and the side of said latch control cam opposite to said one side are ground such that engagement therebetween tends to extend said movable core from said solenoid.

9. A high security door locking device as claimed in claim 8 wherein said solenoid control means ignores all entries for a defined lockout period of time upon entry of a defined number of erroneous codes.

10. A high security door locking device as claimed in claim 9 wherein said control means generates a perceptible signal during said lockout period.

11. A high security door locking device as claimed in claim 8 wherein said solenoid control means is further programmable to permit multiple codes to be selected.

12. A high security door locking device as claimed in claim 11 wherein said solenoid control means includes a time clock and is further programmable to enable use of one or more of said multiple codes only during one or more defined time periods whereby entry can be restricted to said defined time periods.

13. A high security door locking device as claimed in claim 12 wherein said solenoid control means stores all codes entered and the times of entry for later retrieval whereby codes entered into the door locking device and the times of such entry can be reviewed for security analysis.

14. A high security door locking device as claimed in claim 8 further comprising antimagnetic override means for preventing withdrawal of said core into said solenoid by means of a magnetic field.

15. A high security door locking device as claimed in claim 14 wherein said solenoid is inserted into a corresponding horizontal opening in said locking cylinder and said antimagnetic override means comprises a cone-shaped chamber forming a closed end in said opening, said core extending centrally into said chamber upon withdrawal into said solenoid, and a ferrous ball bearing contained within said chamber whereby said solenoid can be operated to withdraw said core unless said ball bearing is initially drawn to the vertex of said cone-shaped chamber by a magnetic field applied to said locking cylinder.

* * * * *